US008544409B2

(12) United States Patent
Herre et al.

(10) Patent No.: US 8,544,409 B2
(45) Date of Patent: Oct. 1, 2013

(54) COATING ZONE WITH INCLINED GUIDE RAILS

(75) Inventors: Frank Herre, Oberriexingen (DE); Juergen Haas, Knittlingen (DE); Michael Baumann, Flein (DE); Marcus Frey, Weil der Stadt (DE); Hans Vetters, Pfaffenhofen (DE); Jan Grigoleit, Bietigheim-Bissingen (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 779 days.

(21) Appl. No.: 12/666,632

(22) PCT Filed: Jun. 23, 2008

(86) PCT No.: PCT/EP2008/005061
§ 371 (c)(1),
(2), (4) Date: May 24, 2010

(87) PCT Pub. No.: WO2009/000491
PCT Pub. Date: Dec. 31, 2008

(65) Prior Publication Data

US 2010/0251963 A1 Oct. 7, 2010

(30) Foreign Application Priority Data

Jun. 25, 2007 (DE) ..... 20 2007 008 852 U

(51) Int. Cl.
*B05C 5/02* (2006.01)
*B05C 15/00* (2006.01)

(52) U.S. Cl.
USPC ..... 118/326; 118/313; 118/323; 901/43

(58) Field of Classification Search
USPC ..... 118/313, 323, 326; 427/427.2, 427.3; 901/43, 27–29
See application file for complete search history.

(56) References Cited

U.S. PATENT DOCUMENTS 5,336,321 A * 8/1994 Sugata et al. ..... 118/315
7,677,196 B2 * 3/2010 Herre ..... 118/326

(Continued)

FOREIGN PATENT DOCUMENTS

DE 102004030858 B3 11/2005
DE 102004056493 A1 1/2006

(Continued)

OTHER PUBLICATIONS

International Search Report for PCT/EP2008/005061 dated Sep. 4, 2008.

*Primary Examiner* — Laura Edwards
(74) *Attorney, Agent, or Firm* — Bejin, VanOphem & Bieneman PLC

(57) ABSTRACT

A coating zone comprises a conveyor for transporting an application object. At least one guide rail extends through the coating zone adjacent the conveyor, arranged above the conveyor at a height at least at the level of the top of the object. At least one robot may move along the conveyor on the guide rail, the robot having a first axis for joint rotation of at least one moving member of the robot in relation to a main body guided along the guide rail. A load-bearing structure supports the at least one guide rail, the load-bearing structure including at least one load-bearing pillar extending substantially vertically downwards from the level of the guide rail. The guide rail and the main body of the robot are arranged in such a way that the first axis of the robot is inclined relative to a vertical plane parallel to the conveying direction.

20 Claims, 5 Drawing Sheets

(56) References Cited

U.S. PATENT DOCUMENTS

| | | | | |
|---|---|---|---|---|
| 2004/0107900 | A1* | 6/2004 | Clifford et al. | 118/305 |
| 2005/0066890 | A1 | 3/2005 | Wetzel | |
| 2006/0040060 | A1 | 2/2006 | Meissner | |

FOREIGN PATENT DOCUMENTS

| | | | |
|---|---|---|---|
| DE | 102006022335 | A1 | 11/2007 |
| EP | 0349177 | A2 | 1/1990 |
| EP | 0745429 | A1 | 12/1996 |
| EP | 0874213 | A2 | 10/1998 |
| EP | 1176388 | A2 | 1/2002 |
| EP | 1263535 | A1 | 12/2002 |
| EP | 1506819 | A2 | 2/2005 |
| EP | 1609532 | A1 | 12/2005 |
| EP | 1704924 | A1 | 9/2006 |
| WO | WO-2004/037430 | A1 | 5/2004 |
| WO | WO-2005046880 | A2 | 5/2005 |

* cited by examiner

COATING ZONE WITH INCLINED GUIDE RAILS

CROSS-REFERENCE TO RELATED APPLICATIONS

This application is a National Phase application claiming the benefit of International Application No. PCT/EP2008/005061, filed Jun. 23, 2008, which claims priority to German Patent Application No. 10 2007 008 852.3, the complete disclosures of which are hereby incorporated by reference in their entireties.

BACKGROUND

The present disclosure relates to a zone of a coating installation and a coating installation with such zones. More specifically, the present disclosure relates to painting zones or other zones of an installation for series coating of application objects such as in particular vehicle bodies or attachments therefor using robots, including painting or other application robots, other manipulators for example for add-on units and/or handling robots such as for example door or bonnet openers.

In conventional paint booths for painting vehicle bodies using robots, the guide rails thereof are conventionally mounted laterally on the booth floor. For various reasons, however, it may be more convenient to arrange robot guide rails above the conveyor or even above the bodies, for example because they then impair the view through the side wall of the booth and the accessibility of the bodies or other application objects less, and/or because the elevatedly arranged robots have correspondingly improved freedom of movement, and/or because the elevatedly arranged guide rails are soiled less by overspray, which is led away downwards by the conventional airflow in the booths. In addition, elevatedly mounted robots may have the advantage that they disturb the airflow flowing downwards from the booth ceiling over the body sides into the booth floor less than robots located on the floor next to the body, which robots narrow the air pathway immediately by the body, which may lead to an undesirable increase in flow velocity.

In a paint shop described in WO 2004/037430 A1, a plurality of painting robots are in each case located on two parallel guide rails, which are in turn mounted on a frame arranged in the interior of the booth, with four pillars connected together by cross members, as in known gantry robot constructions.

EP 1 263 535 B1 also discloses a painting zone in a paint booth for vehicle bodies with air fed in through the upper ceiling and in each case two walk-in control regions arranged vertically one above the other on the side walls, robot guide rails arranged in elevated manner above the conveyor being installed in modular prefabricated side wall elements of the booth. Unlike the frame according to WO 2004/037430 A1 the load-bearing structures of the guide rails are separated from one another in the booth interior, cross members of the load-bearing structures thereby being avoided in the booth interior together with possible problems with regard to the mechanical stability of the known frame. On the floor of these known paint booths, which is formed, as is conventional, by a grating structure for removing the vertical airflow, there are mounted under the elevatedly arranged guide rails next to the lower control region additional guide rails for further robots, the robots of the lower level being painting robots and the upper robots being door or bonnet openers.

Paint booths for vehicle bodies with robot guide rails mounted vertically one above the other on the booth walls and with a plurality of painting zones arranged in succession along the transport path of the conveyor are known from EP 0 745 429 A1.

In the known painting zones with elevated robot guide rails, the side walls of the paint booths extend from the upper ceiling thereof perpendicularly downwards to floor level. Since the paint booths, including the walk-in control regions, must not be too wide in view of structural and investment costs, this gives rise to the fundamental disadvantages of known painting zones. On the one hand, the space available for the control regions is undesirably tight. On the other hand, with a given total width and enlargement of the control regions, the pathways for the airflow flowing downwards in the booth from the ceiling are restricted undesirably.

Another problem is the necessary support for the elevatedly arranged guide rails, which is naturally more difficult to achieve than with guide rails on the booth floor. Sufficient stability for guide rails mounted above the conveyor on a booth wall, in particular without their own crossbars at the level of these guide rails has hitherto been achievable only with an undesirable degree of structural effort for correspondingly stable side walls.

Accordingly, there is a need to provide a coating or other zone of a coating installation or an installation with a plurality of such zones, in which it is made easier for the robot(s) to reach the application object. For example, there is a need for having improved space utilisation while maintaining the best possible airflow and low structural effort.

BRIEF DESCRIPTION OF THE FIGURES

Exemplary illustrations are explained in greater detail in a schematic and simplified manner in the drawings, in which.

DETAILED DESCRIPTION

Figure 1:
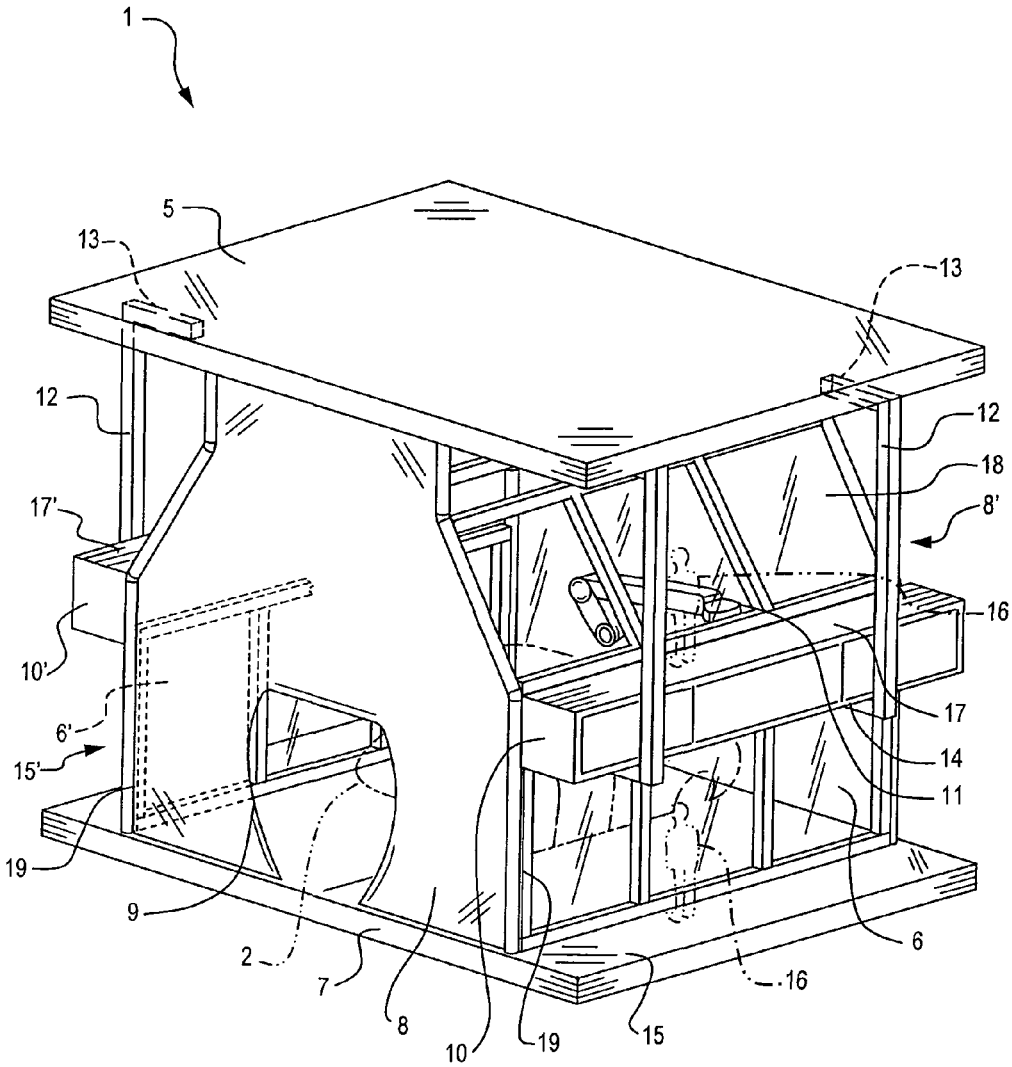
FIG. 1 shows a coating zone according to a first exemplary illustration.

According to a first aspect of the exemplary illustrations, an application object, such as a vehicle body, is made more readily reachable, for example in narrow paint booths, by tilting the guide rails of a painting robot, and thus the working region of the robot, about a longitudinal direction of the rail.

According to a second aspect of the exemplary illustrations, a guide rail may be arranged generally obliquely in the conveying direction, for example at an adjustable angle of inclination, such that the robot may, depending on setting and its respective position in a longitudinal direction of the rail, be located at variable levels next to or above the body or other application object. This also makes the object more readily reachable.

These two aspects may in each case be advantageous in themselves, and also when combined together.

According to another aspect of the exemplary illustrations, a coating zone has, on one or even both sides of the conveying path at the level of elevated robot guide rails, an upper walk-in control region, which is separated from the interior of the coating zone by oblique side walls, whereby the interior becomes progressively narrower upwards in this region. This results, on the outside of the oblique side walls, in a correspondingly wider space for the walk-in control region, which may be utilized both for control devices of the robot located on the elevated guide rail and for the personnel observing the coating process and for maintenance operations. A significant advantage of the arrangement of the control device in the vicinity of the robots controlled thereby is correspondingly short hose and line connections to/around the robots.

At the same time, as a result of the oblique side wall of the flow area available for airflow, the coating zone increases in size moving in a downwards direction, whereby any hindrance to the airflow by the robots may be correspondingly compensated such that the flow velocities change less significantly within the coating zone than for coating zones having walls that are perpendicular from top to bottom. This results, for example in a paint booth or painting zone for vehicle bodies, in optimum air distribution even when the side walls extend perpendicularly next to the body. Excessively strong airflow past the bodies or other application objects would otherwise reduce application efficiency, for example by entrainment of the coating material to be applied.

The side walls may advantageously have an oblique course only at the upper walk-in control region, while at the lower walk-in control region, i.e. at the (typically grating-like) floor, the coating zone may extend generally vertically upwards, for example as far as above the upper edge of the application objects and/or up to the upper control region. In this way, an undesirably large total width is avoided for the coating zone in the floor region.

If only one elevated robot guide rail is present, for example on both sides of the conveyor, the lower walk-in control region may be used on at least one side of the conveyor, for example for observing the coating process without the view being impaired by robots and for maintenance operations, etc. Alternatively, additional guide rails may be provided, e.g., for additional robots on the floor of the coating zone or in the vicinity of floor level on the side wall of the coating zone on one or both sides of the conveyor. The guide rails may be arranged one above the other on each side of the coating zone with such spacing that the respective robots may pass one another in the longitudinal direction parallel to the conveying path. It is also possible for more than two guide rails to be provided on one or each side, in particular at different levels, e.g., at three or more levels spaced vertically from one another. To distribute in each case a plurality of robots on the guide rails, for example including painting and handling robots, there are in particular the options described in DE 10 2004 030858 and DE 10 2004 056493 (EP 1 609 532 A1), the complete contents of which are hereby expressly incorporated by reference in their entireties into the present application. It is additionally possible to mount one or more guide rail arrangements that are spaced apart, e.g., one above the other on one or both sides of the coating zone and of the conveyor, where the guide rail arrangements may in each case contain more than just one rail and be constructed in such a way that robots displaceable on the different, spatially offset rails of one and the same guide rail arrangement may pass one another in a direction generally parallel to the transport path of the conveyor.

The rails mentioned in connection with the present application may advantageously also be used for robots, displaceable thereon, for add-on units, which may be present in addition to application robots with atomisers (applicators) and/or to handling robots (handlers). Examples of add-on units are any desired manipulators including for example mobile dryers, which may irradiate the application objects in a manner known per se with IR or UV radiation for drying purposes, cleaning devices, and also probes and measuring instruments, as are generally known for measuring coating results and layer quality features such as layer thickness, "wave scan", colour shade, gloss, brightness etc. and to detect coating defects. The measurements may proceed on-line, also for on-line quality measurement optionally with automatic defect correction for subsequent application objects, for example according to EP 0 874 213 B1 or EP 1 176 388 A2. The add-on units may be located in a coating booth or in a separate repair or monitoring zone, wherein they may then also be arranged without application robots or door openers or the like on the above-mentioned guide rails. The add-on units may conveniently be mounted on their own robots or, with the assistance of interchangeable heads, also on robots serving generally as supports for different devices such as for example atomizers, dryers, measuring systems etc. If the add-on units are located in a coating zone, they may be displaced on the rails of the application and/or handling robot provided therein or instead on their own rails, which may be height-offset relative to the rails of the application or handling robots.

The term "robot" used here should be understood generally in the sense of a freely programmable multiaxial automaton, for example of articulated construction with at least six rotational axes (three main and three hand axes), the main body of the successive movement axes being displaceable as a carriage on one of the rails here under consideration, similar to the travelling axis (axis 7) of conventional painting robots or the like. It is also possible, however, to mount at least two robot structures with, for example, in each case two or three main axes on a common base member displaceable as a carriage on one and the same rail, which robot structures may, depending on their instance of use, have the same or different functions (coating, handling, measuring etc.) as in the case of robots separately displaceable on the same or separate rails.

As has already been mentioned above, for mounting the guide rails arranged above the conveyor and, if convenient, above the upper edges of the bodies or other application objects for a plurality of robots operating optionally in each case next to one another, special load-bearing structures may be employed, which have hitherto been achieved either by frame constructions placed in the coating or treatment zone or by suitable configuration of the side walls themselves. According to a further aspect of the exemplary illustrations, in contrast, load-bearing structures are provided which are arranged at least one, and in some cases both, of the side walls of the coating zone or monitoring or repair zone and may be connected firmly therewith, which load-bearing structures may be supported with supporting elements extending perpendicularly to the transport path of the conveyor, e.g. on or under the floor of the zone or indeed on the ceiling, such that the side walls do not themselves have to assume any load-bearing function and may accordingly be of simple construction. For example, for the most part the side walls may be of transparent construction even in the lower region for enhanced observation of the coating process. These supporting elements do not therefore have to be constituents of the actual side wall, but rather may be at a distance from the side wall and/or extend generally perpendicularly to the transport path (e.g., in a direction generally parallel to the floor level) away from the side wall.

On the other hand, the load-bearing structures (in contrast with the cross members of the gantry construction according to the above-mentioned WO 2004/037430) may be provided without any supporting elements which extend through the interior of the coating zone above the top of the application objects, such as for example vehicle bodies, but under the ceiling and disturb the vertical airflow of the booth and/or could soil the application objects by paint or other particles adhering thereto and becoming detached again therefrom.

It may be particularly convenient for these load-bearing structures to be combined structurally with the load-bearing or reinforcing elements of the per se conventional partition walls ("silhouettes") needed at the inlet and/or outlet ends of the individual coating zones. The purpose of these partition walls arranged perpendicularly of the conveying path may be, for example, to isolate a plurality of coating zones each with different airflow management arranged in succession in a paint booth, for instance to isolate a zone for electrostatic application with rotary atomizers from a zone for air atomizers, in which different downdraft velocities are required, wherein air mixing and crossflows between the zones must be avoided to the extent possible. In addition, the transverse walls may have safety functions for protecting personnel.

One option is, for example, to attach these partition walls arranged perpendicularly of the conveying path directly to the load-bearing structures of the elevated robot guide rails, thereby avoiding the costs involved in providing the partition walls with their own mounts. In particular, however, a partition wall reinforcing structure may also serve as a load-bearing or supporting structure for the robot guide rails. The load-bearing or supporting structures of the rails may thus be integral components of a partition wall reinforcement, or conversely the reinforcements of the partition walls may be integral components of the load-bearing or supporting structures of the guide rails.

The application objects may be conveyed through the zones in question in a generally continuous operation, with robots generally likewise traveling generally along the conveying path, or instead in cyclical operation, in which the object is at a standstill during treatment.

The same reference numerals are used below for the same or corresponding elements, even across the various exemplary illustrations.

Figure 3:
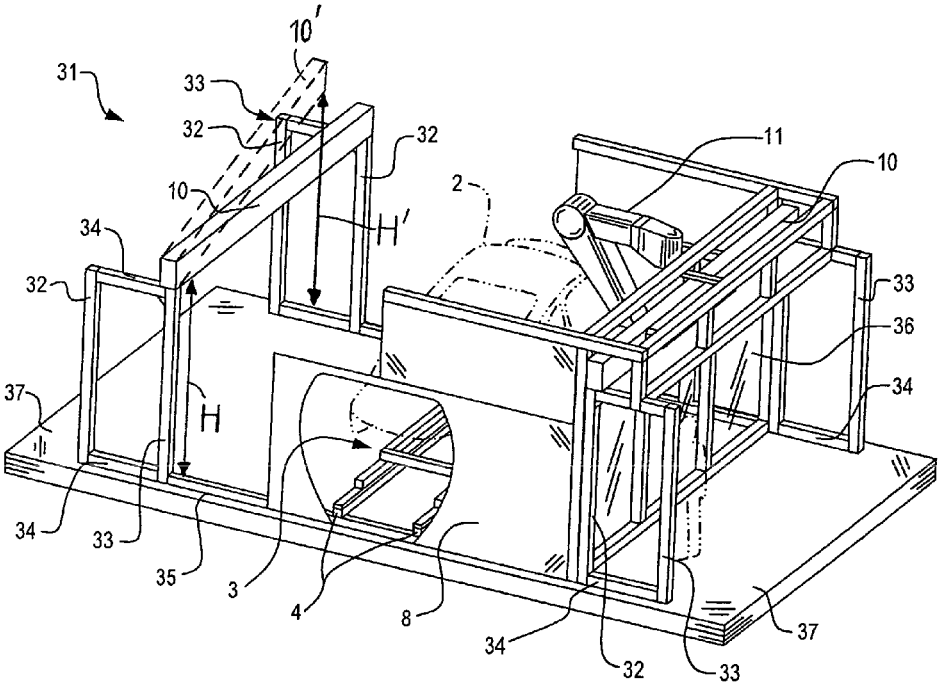
FIG. 3 shows a coating zone according to a third exemplary illustration.

The coating zone 1 for vehicle bodies 2 illustrated in FIG. 1 may form part of a paint booth. The painting zones described here and below may alternatively be arranged inside a wider booth. The bodies may be transported through the coating zone 1 on a conventional floor conveyor 3 (cf. FIG. 3, not shown in FIG. 1) along a transport path defined for example by rails 4 (FIG. 3). The coating zone is generally bounded at the top by a horizontal ceiling 5, on both sides by side walls 6 or 6' arranged parallel to the transport path, at the bottom by the horizontal floor 7 and at the inlet and/or outlet ends by partition walls 8 and 8' arranged perpendicularly to the transport path. Further, similar or different coating zones may follow one another along the transport path, for example in the same paint booth on the outsides of the partition walls 8 and/or 8'. In a per se conventional manner, during operation a substantially vertically downwardly directed airflow is passed through the coating zone 1, which may be introduced for example through the ceiling provided for this purpose with openings or with a separate ventilation means and may exit through the floor 7, configured for example as a grating structure. The partition walls 8 and 8' may be inserted in a generally tight-fitting manner between the wall elements surrounding them, e.g., in particular the side walls 6 and 6', and where possible likewise tightly between the ceiling 5 and the floor 7, in order to prevent air mixing or crossflows in particular between neighboring zones with different airflow management on the two sides of the respective partition wall 8 or 8'. Openings 9 in the partition walls 8 or 8' for the bodies 2 on the conveyor 3 may for this reason also be closable during coating. In addition, closable doors (not shown) for the operating personnel may be situated in the side walls 6, 6' and/or partition walls 8, 8', for example in a metallic frame structure on one or both sides of the partition wall 8, as is illustrated with reference numeral 43 in the exemplary embodiment of FIG. 4, described further below. This results in advantages also with regard to safety such as entry protection while at the same time providing escape routes from the booth and/or coating zone.

According to this illustration, guide rail arrangements 10 and 10' for robots 11 are in each case arranged, for example, around halfway up the side walls 6, 6' and above the tops of the bodies 2, on the side walls in the interior of the coating zone 1. The robots 11 may be equipped with conventional atomizers or other applicators for coating material. In this example, the load-bearing structure for the guide rails takes the form of vertical supports 12, which are anchored in or on the ceiling 5 in suspended manner with support elements 13 lying horizontally transversely of the transport path and which, with lower support elements 14, likewise lying horizontally transversely, in turn bear the guide rail arrangements 10 or 10'. The supports 12 are located on the side remote from the interior of the coating zone 1 of the guide rail arrangements 10 or 10' and the respective side wall 6 or 6'. The ceiling 5 may in this example be a component of the ceiling construction of concrete for example of a larger chamber, in which the coating zone 1 is installed.

The partition walls 8 and 8' are firmly connected at least to the side walls 6 and 6' and may also be attached with their frame 19 directly to the load-bearing structures of the guide rail arrangements 10 and 10'.

On the side of the side walls 6, 6' remote from its interior, on the floor 7 continuing thus far, the coating zone 1 may have in each case a first walk-in control region 15 or 15' for the operating personnel 16. In addition, a second walk-in control region 17 or 17' for operating personnel 16 is provided, likewise on the outside of the side walls 6 or 6', in each case on both sides of the coating zone 1 above the first control region 16 or 16' on the top of the structures containing the guide rail arrangements 10 or 10'. In the upper control regions 17 and 17' at least, there may be located control cabinets (not shown) and other control and supply means for the robot 11.

In the example illustrated, the coating zone 1 contains only the elevated robot guide rail arrangements 10 and 10', but it is still possible to fit a further guide rail for additional robots to the floor 7 between the bodies 2 and the side walls 6 or 6' on one or both sides parallel to the guide rails of the arrangements 10 and 10'.

According to the illustration, the side walls 6 and 6' in the lower control region 15 or 15' extend from the floor 7 perpendicularly upwards as far as the structures containing the guide rail arrangements 10 or 10' and thus in the example illustrated as far as a level above the bodies 2. The part 18 of the side walls 6 and 6' extending upwards from the robot guide rails in the upper walk-in control region 17 or 17' is, in contrast, inclined obliquely inwards according to the illustration, such that the interior of the coating zone 1 becomes continuously narrower in these control regions. The oblique course of the side walls 6 and 6' may, as illustrated, develop into a vertical part again before the ceiling 5 is reached, which part is, however, shorter in the vertical direction than the oblique part 18. The air inlet orifices of the coating zone are located in the region of the ceiling 5 located between the upper end of the side walls 6 and 6'.

The perpendicular lower parts of the side walls 6 and/or 6' may for example be of a height (approx. 2 m) such that straight doors may be fitted for the operating personnel 16.

The side walls 6 and 6' need not themselves have any load-bearing function for other components of the coating zone and may consist at least for the most part of transparent material such as glass, in order to allow the personnel 16 to view the interior. The partition walls 8 and 8' may also be transparent.

The floor 7, which is shown only schematically, may be a sub-structure or load-bearing structure in turn mounted on separate supports (not shown), in or under which structure the electrical, pneumatic and supply line arrangements may extend for the zone in question, for example including the ring mains for supplying paint in the case of a paint booth. Hatches may for example be provided in the floor 7 for access to this supply region.

A modular structure of the zones described here may be particularly convenient, which zones may also be completely or at least partially preassembled by the installation manufacturer and transported to the installation operator in this state, such that the advantages explained inter alia in EP 0 349 177 A are achieved. When retrofitting existing older installations, such preassembled modules may be placed on existing foundations with the assistance of the above-mentioned sub-structure or load-bearing structure as a floor.

Figure 2:
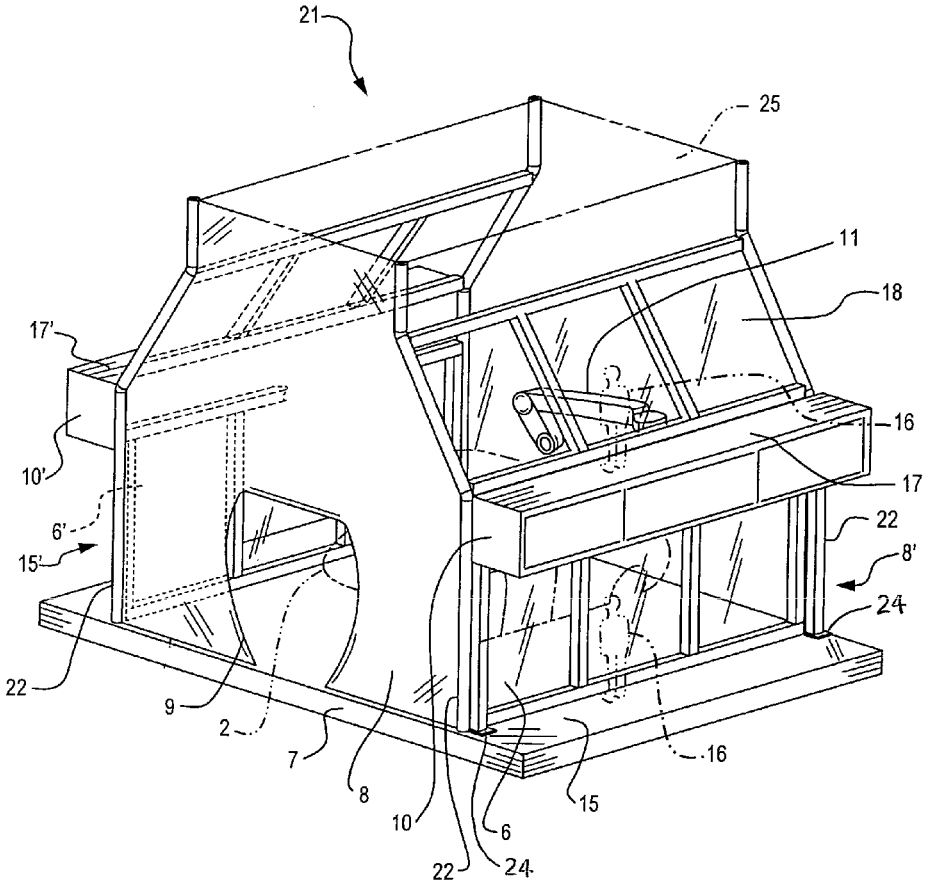
FIG. 2 shows a second exemplary illustration.

The coating zone 21 according to FIG. 2 largely corresponds to the exemplary embodiment according to FIG. 1, such that no fresh description is needed with regard for example to the guide rail arrangements 10 with the robots 11, the side walls 6 with the oblique parts 18, the control regions 15 and 17 and with regard to the partition walls 8. However, the guide rails are here not suspended from a stable ceiling, as shown in FIG. 1, but rather on vertical load-bearing pillars 22. The load-bearing pillars 22 may in turn be supported with horizontal transverse supporting elements, indicated only schematically at 24, on the floor 7, here presupposed to be stable. Suitable transverse supporting elements may also be located under the floor 7. The air-permeable ceiling 25 of the coating zone 21 may be constructed as in the case of conventional paint booths.

The coating zone 31 illustrated in FIG. 3 may correspond to the above-described exemplary embodiments with regard to the walk-in control regions and the partially oblique side walls, although this is not shown here. The structure according to FIG. 3 is however also suitable for a coating zone without these features. The embodiment of FIG. 3 corresponds to FIG. 1 and FIG. 2 at any rate with regard to guide rail arrangements 10 for robots 11 arranged above the conveyor 3 and optionally above the bodies 2. The conveyor 3 illustrated in FIG. 3 with the rails 4 for the bodies 2 may also be used in the exemplary illustrations shown in FIG. 1 and FIG. 2.

In particular, the load-bearing structures for the elevated guide rail arrangements 10 are configured here unlike in the exemplary embodiments described above. These load-bearing structures substantially consist of frame structures 33 for example of the illustrated rectangular shape with two vertical load-bearing pillars 32 connected by upper and lower horizontal transverse supporting elements 34. In this example, the frame structures 33 are located in each case in a plane located vertically transversely of the conveying rails 4 on the side of the guide rail arrangements 10 for the robot 11 remote from the conveyor 3 and thus on the outside of the side walls 36 on a floor part 37. As illustrated, such a frame may be arranged under each of the ends of the guide rail arrangements 10 adjoining the outside of the side wall 36, which is vertical at this point, which frame rests with the lower transverse supporting element 34 on the floor part 37 and on its upper transverse supporting element bears the guide rail arrangement 10. Further, such frame or other supports (not shown) may also be provided. The two frame structures 33 serving as load-bearing structures for the robot guide rails at the inlet and outlet ends of the coating zone 31 may be joined together in the vicinity of the floor plane and conveniently under the conveyor 3 by a cross strut 35. Such cross struts for the frame structures 33 may also be arranged at the level of the guide rail arrangements 10.

The partition walls 8 of the coating zone 31 provided at the inlet and/or outlet ends may conveniently be inserted between the adjacent frame structures 33 parallel thereto, which may here serve at the same time as reinforcing or frame structures for the partition wall in addition to their function as a load-bearing structure for the robot guide rails, and optionally the cross struts 35 of the frame structures 33.

Figure 4:
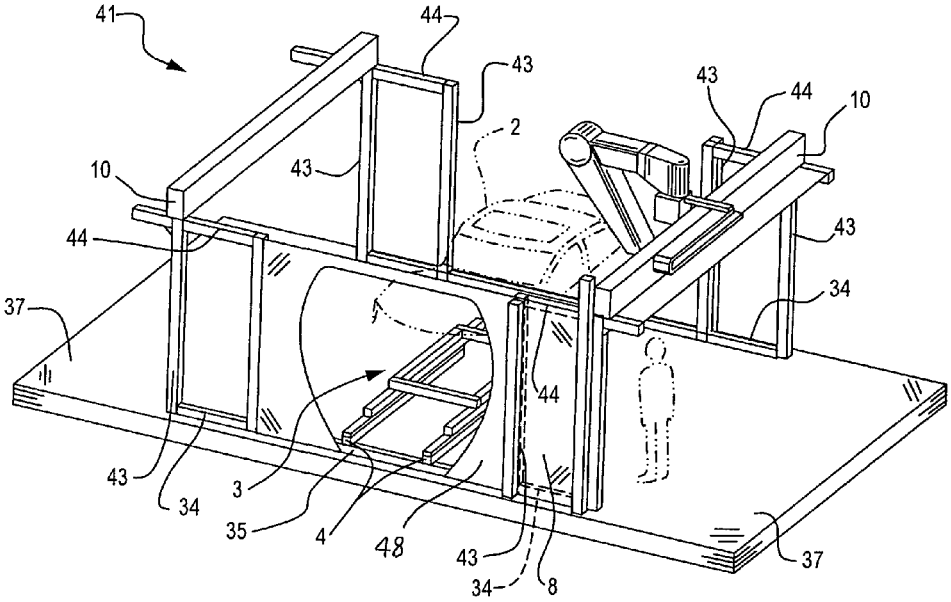
FIG. 4 shows a modification of the exemplary illustration according to FIG. 3.

The coating zone 41 illustrated in FIG. 4 is a modification of the exemplary embodiment according to FIG. 3, from which it differs generally in that the frames 43 serving as a load-bearing structure for the guide rail arrangements 10 of the robots and corresponding in principle to the frame structure 33 do not extend onto the side of the robot guide rails and of the side walls remote from the conveyor 3 but rather are arranged, according to the illustration, on the side facing the conveyor. The guide rails 10 here lie, according to the illustration, on a horizontally outwardly directed extension of the upper transverse supporting elements 44 of the frames 43. Here too the partition wall 48 is inserted in tight-fitting manner between the frames 43 serving as a reinforcement for the partition wall, i.e. the load-bearing structures of the robot guide rails. The frame structures 43 (or 33 in FIG. 3) may contain transparent or other wall elements.

The above-described exemplary illustrations may be modified in various respects, in particular also with regard to the rail arrangements. It may for example be convenient to arrange transverse rails inside or outside the coating zone (or a monitoring or repair zone in the case of the above-mentioned add-on units) up- and/or downstream of the treatment zone, said transverse rails extending, for example, generally perpendicularly (Y direction) to the rails extending parallel to the conveying direction (X direction) of the application objects, in the plane or planes of the cross rails. These transverse rails may also be arranged above the application objects and may be joined to the associated cross rail(s) in the same plane in such a way that the relevant robot may cross over the from the cross rail to the transverse rail and vice versa and/or between the cross rails on opposing sides of the conveying path, for example in any manner known from conveying technology that is convenient.

Another modification option involves installing guide rails with an in particular horizontal, for example closed, course curved in the shape of a circle or part of a circle or for example an oval, for example symmetrical relative to the conveying path or relative to a vertical axis, instead of the above-described linear rail arrangements. Here too, a rail arrangement above the application objects such as for example vehicle bodies may be particularly advantageous.

Rail arrangements modified in this way may also be convenient in installations in which features of the exemplary illustrations described here are not produced, in particular with regard to the oblique course of the side walls or the particular load-bearing structure and its supporting elements, although they may on the other hand also be combined with any of the other features of the described exemplary illustrations. In particular, the X-Y rail arrangements with robot crossover possibilities and the rail arrangements with a curved or circular course are also suitable for suspended mounting in a coating, monitoring or repair zone. Suspended mounting, for example on a booth ceiling or on an oblique side wall of a booth may be effected in particular in the manner described in U.S. Pat. No. 7,677,196, issued Mar. 16, 2010, the full contents of which are hereby expressly incorporated by reference in its entirety in the disclosure of the present application.

The above-mentioned arrangement of add-on units on guide rails may also be combined with any of the other features described in the present application, likewise without being limited to the above-stated features of the exemplary illustrations, since it has independent advantages, such as for example good utilization of space and reduction of structural complexity in a coating installation and, when common robots are used for various apparatuses, also a reduction in machine and control complexity.

In general, the combination of any of the features described in this application with one or more other described features without limitation to other features is possible and, depending on the example, advantageous.

The described zones may be arranged one after the other in a conventional line coating installation. They may also be arranged parallel to one another, for example where the transport path for the application objects branches into a plurality of parallel branches, in which in each case at least one of the treatment zones is arranged, as described in patent application DE 10 2006 022 335, the full contents of which are hereby expressly incorporated by reference in its entirety in the disclosure of the present application.

In all the exemplary illustrations with coating zones, the robot guide rails may advantageously be configured and arranged in such a way that the rails and robots do not affect the airflow in the booth or at least do not do so significantly. This is achieved by a generally slim structure and/or by positioning of the rail outside, for example above, the painting region.

Figure 5:
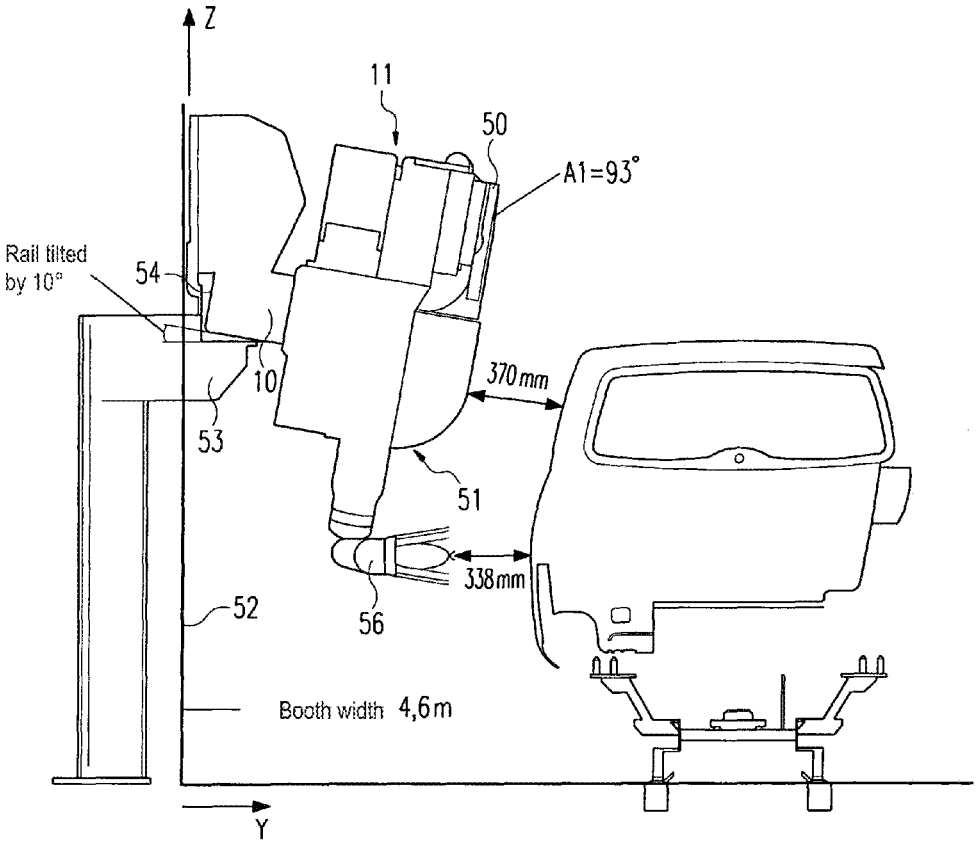
FIG. 5 shows the arrangement of a painting robot on a guide rail tilted about its longitudinal direction.

FIG. 5 shows an exemplary painting robot 11 on its guide rail 10, which may in itself be configured and designed as is currently conventional in practice for elevated painting robots (cf. for example EP 1 609 532 or WO 2005/046880), with the illustrated substantially rectangular cross-sectional profile, on whose side facing the inside of the booth the main body 51 of the robot 11 is slidingly mounted. The position of the robot may be defined in the conventional manner in relation to the X, Y and Z axes of the booth chamber, the X axis corresponding to the conveying direction, the Z axis extending vertically upwards and the Y axis extending horizontally transversely of the booth wall 52. On the main body 51 guided by the rail 10 the arrangement 50 formed by the robot arms is mounted so as to rotate about a common first robot axis (A1), which conventionally extends substantially vertically in conventional installations. However, according to the illustration the plane of the underside of the rail profile is tilted relative to the horizontal plane and relative to the Z axis about the longitudinal direction of the rail, i.e. about the X axis (not shown, extending perpendicularly to the plane of FIG. 5), for example by roughly 10°, such that the guide plane located between the rail profile and the main body 51 and thus the first axis (A1), parallel to the guide plane, of the robot is tilted by the same angle relative to the vertical plane parallel to the conveying direction, for example in the tilting direction in which the robot parts located below the rail are closer to the booth wall than the parts located thereabove, as shown in FIG. 5. In the position illustrated, the common plane of the two robot arms also lies parallel to the inclined guide plane.

According to the illustration, the guide rail 10 is mounted on the top of a support 53 extending generally horizontally through the booth wall 52 and is set back with its end 54 horizontally remote from the inner wall of the booth as far as the vicinity of the booth wall 52, in order to make the best possible use of the given booth width.

The maximum angle of rotation of the main body 50 of the robot about the first robot axis (A1) may be greater than 90°, for example roughly 93°, which may be achieved by appropriate modification of the associated power chain system.

In the case of a narrow booth, for example with a width of 4600 mm as illustrated, the tilted arrangement allows a desired coating process to be performed with the desired distances (for example 370 mm or 338 mm) of the robot 11 and its atomizer 56 from a body 1800 mm wide.

The arrangement of guide rails and thus of the entire robot tilted inwards as described into the spray booth may also be sensible in the case of robots without the above-mentioned first axis (A1). The tilt angle may also be adjustable.

The above-mentioned second aspect of the exemplary illustrations is explained with reference to FIG. 3, in which the robot guide rails 10 are shown as being in themselves horizontal, i.e. as extending parallel to the booth floor. According to this example, however, the rails 10 may instead be tilted about the Y axis (FIG. 5), i.e. arranged obliquely in the conveying direction in a vertical plane parallel thereto, as indicated at 10', such that the height H of the rail above the booth floor is less at one end than the height H' at the other end (or vice versa).

Whether the rails are higher at the inlet end or at the outlet end of the painting zone depends on the particular process technology. The oblique rails may be fixedly mounted. Alternatively, the angle of inclination of the rails may be adjustable, for example by hydraulic lengthening or shortening of their vertical supports 32, 33. The swivel axis may here lie at the one rail end or instead also at an optionally variable, central position in the longitudinal direction of the rail. The angle of inclination may be adjusted from 0 (horizontal position) to an angular value which has proven convenient in practice.

The described tilting and inclining arrangements are suitable inter alia for each of the various painting zones described above with reference to FIGS. 1-4.

The exemplary illustrations are not limited to the specific examples described above. Rather, a plurality of variants and modifications are possible, which likewise make use of the concepts of the exemplary illustrations and therefore fall under the scope of protection. Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description.

The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A coating zone, comprising:

part of a paint booth;

a conveyor for transporting an application object through the coating zone in a conveying direction, at least one guide rail extending through the coating zone adjacent the conveyor, the at least one guide rail arranged above the conveyor at a height being at least at the level of the top of the object, at least one robot configured to move along the conveyor on the guide rail, the robot being capable of being configured to perform a coating operation and having a first axis for joint rotation of at least one moving member of the robot in relation to a main body guided along the guide rail, and a load-bearing structure supporting the at least one guide rail, the load-bearing structure including at least one load-bearing pillar extending substantially vertically downwards from the level of the guide rail, wherein the guide rail and the main body of the robot are arranged in such a way that the first axis of the robot is inclined relative to a vertical plane parallel to the conveying direction.

2. The coating zone according to claim 1, wherein the angle of inclination of the first axis relative to the vertical plane is approximately 10°.

3. The coating zone according to claim 1, wherein the guide rail is mounted on top of a horizontal support extending horizontally through a side wall of the coating zone and is set back with its end remote from the interior of the zone as far as the vicinity of the side wall.

4. The coating zone according to claim 1, wherein a maximum angle of rotation of the main body about the first axis is greater than 90°.

5. The coating zone according to claim 1, wherein the guide rail is inclined in a vertical plane substantially parallel to the conveying direction relative to a horizontal plane.

6. The coating zone according to claim 5, wherein an angle of inclination of the guide rail and the robot is adjustable in relation to the horizontal plane.

7. The coating zone according to claim 1, comprising an upper ceiling, through which feed air enters the coating zone, two side walls arranged on opposing sides of the conveyor, which extend from the ceiling downwards as far as a floor level, a first walk-in control region, which is located at floor level on the outside remote from the conveyor of at least one of the two side walls, and a second walk-in control region, which is located on the outside of at least one of the two side walls in the vicinity of the guide rail above the first walk-in control region and above the conveyor, wherein the side wall extends obliquely upwards at the upper walk-in control region with a progressive reduction in the width of the interior of the coating zone.

8. The coating zone according to claim 7, wherein the at least one guide rail is positioned at a guide rail height, the guide rail height being at least as great as an upper end of the lower control region.

9. The coating zone according to claim 1, further comprising:

at least one mutually separate load-bearing structures at least one side of the conveyor configured to provide lateral support of the at least one guide rail, an upper ceiling, and two side walls arranged on opposing sides of the conveyor, the two side walls extending from the ceiling downwards to a floor level, wherein one of the at least one load-bearing structures arranged laterally on a first one of the side wall next to the transport path of the conveyor, leaving the transport path open, is supported at one of on the floor level, under the floor level, and on the ceiling, with supporting elements of the one of the at least one load-bearing structures extending transversely of the transport path.

10. The coating zone according to claim 1, wherein two guide rails for robots are arranged one above the other on at least one side of the conveyor.

11. The coating zone according to claim 1, further comprising at least one coating robot on at least one of the guide rails, and at least one add-on unit is displaceable on at least one of the guide rails, the at least one add-on unit including one of a mobile dryer, a probe, and a measuring instrument.

12. The coating zone according to claim 11, wherein an add-on unit and an application device of the coating installation are each displaceable in the zone on one of a common guide rail and their own guide rails.

13. A coating installation having a plurality of coating zones according to claim 1, wherein the individual coating zones are arranged one of one after the other and parallel to one another along a transport path.

14. A coating zone, comprising:

part of a paint booth;

a conveyor for transporting an application object through the coating zone in a conveying direction, two guide rails, each of the guide rails extending through the coating zone adjacent the conveyor, each of the guide rails arranged above the conveyor at a height being at least at the level of the top of the object, at least one robot that is capable of being configured to perform a coating operation and that is configured to move along the conveyor on each of the guide rails, the robots each having a first axis for joint rotation of at least one moving member of the robot in relation to a main body guided along the respective guide rail, and respective load-bearing structures supporting each of the guide rails, each of the load-bearing structures including at least one load-bearing pillar extending substantially vertically downwards from the level of a respective one of the guide rails, wherein the guide rails and the main bodies of the robots are arranged in such a way that the first axis of each robot is inclined relative to a vertical plane parallel to the conveying direction.

15. The coating zone according to claim 14, wherein the angle of inclination of the first axis of each robot relative to the vertical plane is approximately 10°.

16. The coating zone according to claim 14, wherein the guide rails are each mounted on top of a horizontal support extending horizontally through a side wall of the coating zone and is set back with its end remote from the interior of the zone as far as the vicinity of the side wall.

17. The coating zone according to claim 14, wherein a maximum angle of rotation of the main bodies of each of the robots about their respective first axes are greater than 90°.

18. The coating zone according to claim 14, wherein at least one of the guide rails is inclined in a vertical plane substantially parallel to the conveying direction relative to a horizontal plane.

19. The coating zone according to claim 18, wherein an angle of inclination of the at least one guide rail and the robot associated with the at least one guide rail is adjustable in relation to the horizontal plane.

20. The coating zone according to claim 1, further comprising:

an upper ceiling, through which feed air enters the coating zone, two side walls arranged on opposing sides of the conveyor, which extend from the ceiling downwards as far as a floor level, a first walk-in control region, which is located at a floor level on the outside remote from the conveyor of at least one of the two side walls, and a second walk-in control region, which is located on the outside of the at least one of the two side walls in the vicinity of the guide rail above the first walk-in control region and above the conveyor, wherein the side wall extends obliquely upwards at the upper walk-in control region with a progressive reduction in the width of the interior of the coating zone.

* * * * *